US009979078B2

(12) United States Patent
Koskiniemi

(10) Patent No.: US 9,979,078 B2
(45) Date of Patent: May 22, 2018

(54) MODULAR CELL ANTENNA APPARATUS AND METHODS

(71) Applicant: Pulse Finland OY, Kempele (FI)

(72) Inventor: Kimmo Koskiniemi, Oulu (FI)

(73) Assignee: PULSE FINLAND OY, Oulunsalo (FI)

( * ) Notice: Subject to any disclaimer, the term of this patent is extended or adjusted under 35 U.S.C. 154(b) by 962 days.

(21) Appl. No.: 13/794,290

(22) Filed: Mar. 11, 2013

(65) Prior Publication Data

US 2014/0118196 A1 May 1, 2014

Related U.S. Application Data

(60) Provisional application No. 61/718,637, filed on Oct. 25, 2012.

(51) Int. Cl.
*H01Q 1/42* (2006.01)
*H01Q 1/24* (2006.01)
(Continued)

(52) U.S. Cl.
CPC ..... *H01Q 1/42* (2013.01); *H01Q 1/246* (2013.01); *H01Q 19/106* (2013.01); *H01Q 21/065* (2013.01); *H01Q 21/205* (2013.01)

(58) Field of Classification Search
CPC ..... H01Q 1/38; H01Q 1/42
(Continued)

(56) References Cited

U.S. PATENT DOCUMENTS 2,745,102 A 5/1956 Norgorden
3,938,161 A 2/1976 Sanford
(Continued)

FOREIGN PATENT DOCUMENTS

CN 1316797 10/2007
DE 10104862 8/2002
(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.
(Continued)

*Primary Examiner* — Dameon E Levi
*Assistant Examiner* — Walter Davis
(74) *Attorney, Agent, or Firm* — Gazdzinski & Associates, PC

(57) ABSTRACT

Simple, low-cost and modular antenna apparatus and methods associated therewith. In one embodiment, a modular antenna element that can be used either alone or as a basic "building block" for larger arrays and sectorial antennas (i.e., by joining needed number of elements together) is provided. The same parts can be reused for various complete product designs, thereby advantageously reducing the need for customized parts (and the attendant disabilities associated therewith). Moreover, multiple antenna elements can be readily joined together via a common feed network (in one implementation, via the back portion of each element). The antenna gain and beam width are also adjustable through configuration of the array (and the construction of the antenna elements themselves).

15 Claims, 12 Drawing Sheets

(51) Int. Cl.
*H01Q 19/10* (2006.01)
*H01Q 21/06* (2006.01)
*H01Q 21/20* (2006.01)

(58) Field of Classification Search
USPC ..... 343/700 MS, 702, 872
See application file for complete search history.

(56) References Cited

U.S. PATENT DOCUMENTS 4,004,228 A 1/1977 Mullett
4,028,652 A 6/1977 Wakino et al.
4,031,468 A 6/1977 Ziebell et al.
4,054,874 A 10/1977 Oltman
4,069,483 A 1/1978 Kaloi
4,123,756 A 10/1978 Nagata et al.
4,123,758 A 10/1978 Shibano et al.
4,131,893 A 12/1978 Munson et al.
4,201,960 A 5/1980 Skutta et al.
4,255,729 A 3/1981 Fukasawa et al.
4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,653,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,835,538 A 5/1989 McKenna et al.
4,835,541 A 5/1989 Johnson et al.
4,862,181 A 8/1989 PonceDeLeon et al.
4,879,533 A 11/1989 De Muro et al.
4,896,124 A 1/1990 Schwent
4,907,006 A 3/1990 Nishikawa et al.
4,954,796 A 9/1990 Green et al.
4,965,537 A 10/1990 Kommrusch
4,977,383 A 12/1990 Niiranen
4,980,694 A 12/1990 Hines
5,016,020 A 5/1991 Simpson
5,017,932 A 5/1991 Ushiyama et al.
5,043,738 A 8/1991 Shapiro et al.
5,047,739 A 9/1991 Kuokkanene
5,053,786 A 10/1991 Silverman et al.
5,057,847 A 10/1991 Vaeisaenen
5,061,939 A 10/1991 Nakase
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,280 A 8/1995 Baudart
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,526,003 A 6/1996 Ogawa et al.
5,528,249 A * 6/1996 Gafford ..... H01Q 1/425 343/700 MS
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,566,441 A 10/1996 Marsh et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prodhomme et al.
5,668,561 A 8/1997 Perrotta et al.
5,675,301 A 10/1997 Nappa
5,689,221 A 11/1997 Niiranen
5,694,135 A 12/1997 Dikun et al.
5,696,517 A 12/1997 Kawahata et al.
5,703,600 A 12/1997 Burrell et al.
5,709,823 A 1/1998 Hahn
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,777,585 A 5/1998 Tsuda et al.
5,760,746 A 6/1998 Kawahata
5,764,190 A 6/1998 Murch et al.
5,767,809 A 6/1998 Chuang et al.
5,768,217 A 6/1998 Sonoda et al.
5,777,581 A 7/1998 Lilly et al.
5,793,269 A 8/1998 Ervasti
5,797,084 A 8/1998 Tsuru et al.
5,812,094 A 9/1998 Maldonado
5,815,048 A 9/1998 Ala-Kojola
5,822,705 A 10/1998 Lehtola

(56) References Cited

U.S. PATENT DOCUMENTS 5,828,339 A * 10/1998 Patel ..... H01Q 1/246 343/700 MS
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Tadahiko et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Anders et al.
6,097,345 A 8/2000 Walton
6,100,849 A 8/2000 Tsubaki et al.
6,112,108 A 8/2000 Tepper et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,246,368 B1 6/2001 Deming et al.
6,252,552 B1 6/2001 Tarvas et al.
6,252,554 B1 6/2001 Isohatala
6,255,994 B1 7/2001 Saito
6,259,029 B1 7/2001 Hand
6,268,831 B1 7/2001 Sanford
6,281,848 B1 8/2001 Nagumo et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 2/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Kuriyama et al.
6,600,449 B2 7/2003 Onaka
6,650,295 B2 7/2003 Ollikainen et al.
6,603,430 B1 8/2003 Hill et al.
6,606,016 B2 8/2003 Takamine et al.
6,611,235 B2 8/2003 Barna et al.
6,614,400 B2 9/2003 Egorov
6,614,401 B2 9/2003 Onaka et al.
6,614,405 B1 9/2003 Mikkoken
6,634,564 B2 10/2003 Kuramochi
6,636,181 B2 10/2003 Asano
6,639,564 B2 10/2003 Johnson
6,646,606 B2 11/2003 Mikkola
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Varjakka
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,809,686 B2 * 10/2004 Du ..... H01Q 1/3275 343/700 MS
6,819,287 B2 11/2004 Sullivan et al.
6,819,293 B2 11/2004 Johannes et al.
6,825,818 B2 11/2004 Toncich
6,836,249 B2 12/2004 Kenoun et al.
6,847,329 B2 1/2005 Ikegaya et al.
6,856,293 B2 2/2005 Bordi

(56) References Cited

U.S. PATENT DOCUMENTS 6,862,437 B1 3/2005 McNamara
6,862,441 B2 3/2005 Ella
6,873,291 B2 3/2005 Aoyama
6,876,329 B2 4/2005 Milosavljevic
6,879,293 B2 * 4/2005 Sato ..... G06F 1/1616 343/700 MS
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar
6,927,729 B2 8/2005 Legay
6,937,196 B2 8/2005 Korva
6,950,065 B2 9/2005 Ying et al.
6,950,066 B2 9/2005 Hendler et al.
6,950,068 B2 9/2005 Bordi
6,950,072 B2 9/2005 Miyata et al.
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,980,158 B2 12/2005 Iguchi et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kojima et al.
7,034,752 B2 4/2006 Sekiguchi et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,061,430 B2 6/2006 Zheng et al.
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,129,893 B2 10/2006 Otaka et al.
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,215,283 B2 5/2007 Boyle
7,218,280 B2 5/2007 Annamaa
7,218,282 B2 5/2007 Humpfer et al.
7,224,313 B2 5/2007 McKinzie, III et al.
7,230,574 B2 6/2007 Johnson
7,233,775 B2 6/2007 De Graauw
7,237,318 B2 7/2007 Annamaa
7,256,743 B2 8/2007 Korva
7,274,334 B2 9/2007 O'Riordan et al.
7,283,097 B2 10/2007 Wen et al.
7,289,064 B2 10/2007 Cheng
7,292,200 B2 11/2007 Posluszny et al.
7,319,432 B2 1/2008 Andersson
7,330,153 B2 2/2008 Rentz
7,333,067 B2 2/2008 Hung et al.
7,339,528 B2 3/2008 Wang et al.
7,340,286 B2 3/2008 Kempele
7,345,634 B2 3/2008 Ozkar et al.
7,352,326 B2 4/2008 Korva
7,355,270 B2 4/2008 Hasebe et al.
7,358,902 B2 4/2008 Erkocevic
7,375,695 B2 5/2008 Ishizuka et al.
7,381,774 B2 6/2008 Bish et al.
7,382,319 B2 6/2008 Kawahata et al.
7,385,556 B2 6/2008 Chung et al.
7,388,543 B2 6/2008 Vance
7,391,378 B2 6/2008 Mikkola
7,405,702 B2 7/2008 Annamaa et al.
7,417,588 B2 8/2008 Castany et al.
7,418,990 B2 9/2008 Vylasek
7,423,592 B2 9/2008 Pros et al.
7,432,860 B2 10/2008 Huynh
7,439,929 B2 10/2008 Ozkar
7,443,344 B2 10/2008 Boyle
7,468,700 B2 12/2008 Milosavljevic
7,468,709 B2 12/2008 Niemi
7,501,983 B2 3/2009 Mikkola
7,502,598 B2 3/2009 Kronberger
7,589,678 B2 9/2009 Nissinen et al.
7,616,158 B2 11/2009 Mark et al.
7,633,449 B2 12/2009 Oh
7,663,551 B2 2/2010 Nissinen
7,679,565 B2 3/2010 Sorvala
7,692,543 B2 4/2010 Copeland
7,710,325 B2 5/2010 Cheng
7,724,204 B2 5/2010 Annamaa
7,760,146 B2 7/2010 Ollikainen
7,764,245 B2 7/2010 Loyet
7,786,938 B2 8/2010 Sorvala
7,800,544 B2 9/2010 Thornell-Pers
7,825,862 B2 * 11/2010 Cheng ..... H01Q 1/2258 343/700 MS
7,830,327 B2 11/2010 He
7,843,397 B2 11/2010 Boyle
7,876,274 B2 * 1/2011 Hobson ..... H01Q 1/243 343/702
7,889,139 B2 2/2011 Hobson et al.
7,889,143 B2 2/2011 Milosavljevic
7,901,617 B2 3/2011 Taylor
7,903,035 B2 3/2011 Mlkkola et al.
7,916,086 B2 3/2011 Koskiniemi et al.
7,963,347 B2 6/2011 Pabon
7,973,720 B2 7/2011 Sorvala
8,049,670 B2 11/2011 Jung et al.
8,098,202 B2 1/2012 Annamaa et al.
8,179,322 B2 5/2012 Nissinen
8,193,998 B2 6/2012 Puente et al.
8,378,892 B2 2/2013 Sorvala
8,466,756 B2 6/2013 Milosavljevic et al.
8,473,017 B2 6/2013 Milosavljevic et al.
8,564,485 B2 10/2013 Milosavljevic et al.
8,629,813 B2 1/2014 Milosavljevic
2001/0050636 A1 12/2001 Weinberger
2002/0183013 A1 12/2002 Auckland et al.
2002/0196192 A1 12/2002 Nagumo et al.
2003/0146873 A1 8/2003 Blancho
2004/0090378 A1 5/2004 Dai et al.
2004/0137950 A1 7/2004 Bolin et al.
2004/0145525 A1 7/2004 Annabi et al.
2004/0171403 A1 9/2004 Mikkola
2005/0055164 A1 3/2005 Neff et al.
2005/0057401 A1 3/2005 Yuanzhu
2005/0159131 A1 7/2005 Shibagaki et al.
2005/0176481 A1 8/2005 Jeong
2006/0071857 A1 4/2006 Pelzer
2006/0192723 A1 8/2006 Harada
2007/0042615 A1 2/2007 Liao
2007/0082789 A1 4/2007 Nissila
2007/0152881 A1 7/2007 Chan
2007/0188388 A1 8/2007 Feng
2008/0059106 A1 3/2008 Wight
2008/0088511 A1 4/2008 Sorvala
2008/0266199 A1 10/2008 Milosavljevic
2009/0009415 A1 1/2009 Tanska
2009/0135066 A1 5/2009 Raappana et al.
2009/0174604 A1 7/2009 Keskitalo

(56) References Cited

U.S. PATENT DOCUMENTS

| | | | | |
|---|---|---|---|---|
| 2009/0196160 | A1 | 8/2009 | Crombach | |
| 2009/0197654 | A1 | 8/2009 | Teshima | |
| 2009/0231213 | A1 | 9/2009 | Ishimiya | |
| 2010/0220016 | A1 | 9/2010 | Nissinen | |
| 2010/0244978 | A1 | 9/2010 | Milosavljevic | |
| 2010/0309089 | A1* | 12/2010 | Collinson | H01Q 1/42 343/872 |
| 2010/0309092 | A1 | 12/2010 | Lambacka | |
| 2011/0133994 | A1 | 6/2011 | Korva | |
| 2012/0119955 | A1 | 5/2012 | Milosavljevic et al. | |

FOREIGN PATENT DOCUMENTS

| | | |
|---|---|---|
| DE | 10150149 | 4/2003 |
| EP | 0 208 424 | 1/1987 |
| EP | 0 376 643 | 4/1990 |
| EP | 0 751 043 | 4/1997 |
| EP | 0 807 988 | 11/1997 |
| EP | 0 831 547 | 3/1998 |
| EP | 0 851 530 | 7/1998 |
| EP | 1 294 048 | 1/1999 |
| EP | 1 014 487 | 6/2000 |
| EP | 1 024 553 | 8/2000 |
| EP | 1 067 627 | 1/2001 |
| EP | 0 923 158 | 9/2002 |
| EP | 1 329 980 | 7/2003 |
| EP | 1 361 623 | 11/2003 |
| EP | 1 406 345 | 4/2004 |
| EP | 1 453 137 | 9/2004 |
| EP | 1 220 456 | 10/2004 |
| EP | 1 467 456 | 10/2004 |
| EP | 1 753 079 | 2/2007 |
| FI | 1 20020829 | 11/2003 |
| FI | 118782 | 3/2008 |
| FR | 2553584 | 10/1983 |
| FR | 2724274 | 3/1996 |
| FR | 2873247 | 1/2006 |
| GB | 2266997 | 11/1993 |
| GB | 2360422 | 9/2001 |
| GB | 2389246 | 12/2003 |
| JP | 59-202831 | 11/1984 |
| JP | 60-206304 | 10/1985 |
| JP | 61-245704 | 11/1986 |
| JP | 06-152463 | 5/1994 |
| JP | 07-131234 | 5/1995 |
| JP | 07-221536 | 8/1995 |
| JP | 07-249923 | 9/1995 |
| JP | 07-307612 | 11/1995 |
| JP | 08-216571 | 8/1996 |
| JP | 09-083242 | 3/1997 |
| JP | 09-260934 | 10/1997 |
| JP | 09-307344 | 11/1997 |
| JP | 10-028013 | 1/1998 |
| JP | 10-107671 | 4/1998 |
| JP | 10-173423 | 6/1998 |
| JP | 10-209733 | 8/1998 |
| JP | 10-224142 | 8/1998 |
| JP | 10-322124 | 12/1998 |
| JP | 10-327011 | 12/1998 |
| JP | 11-004113 | 1/1999 |
| JP | 11-004117 | 1/1999 |
| JP | 11-068456 | 3/1999 |
| JP | 11-127010 | 5/1999 |
| JP | 11-127014 | 5/1999 |
| JP | 11-136025 | 5/1999 |
| JP | 11-355033 | 12/1999 |
| JP | 2000-278028 | 10/2000 |
| JP | 2001-053543 | 2/2001 |
| JP | 2001-267833 | 9/2001 |
| JP | 2001-217631 | 10/2001 |
| JP | 2001-326513 | 11/2001 |
| JP | 2002-319811 | 10/2002 |
| JP | 2002-329541 | 11/2002 |
| JP | 2002-335117 | 11/2002 |
| JP | 2003-060417 | 2/2003 |
| JP | 2003-124730 | 4/2003 |
| JP | 2003-179426 | 6/2003 |
| JP | 2004-112028 | 4/2004 |
| JP | 2004-363859 | 12/2004 |
| JP | 2005-005985 | 1/2005 |
| JP | 2005-252661 | 9/2005 |
| KR | 20010080521 | 10/2001 |
| KR | 20020096016 | 12/2002 |
| SE | 511900 | 12/1999 |
| WO | WO 1992/000635 | 1/1992 |
| WO | WO 1996/027219 | 9/1996 |
| WO | WO 1998/001919 | 1/1998 |
| WO | WO 1999/030479 | 6/1999 |
| WO | WO 2001/020718 | 3/2001 |
| WO | WO 2001/029927 | 4/2001 |
| WO | WO 2001/033665 | 5/2001 |
| WO | WO 2001/061781 | 8/2001 |
| WO | WO 2004/017462 | 2/2004 |
| WO | WO 2004/057697 | 7/2004 |
| WO | WO 2004/100313 | 11/2004 |
| WO | WO 2004/112189 | 12/2004 |
| WO | WO 2005/062416 | 7/2005 |
| WO | WO 2007/012697 | 2/2007 |
| WO | WO 2010/122220 | 10/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. And M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng-Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. And H. S. Tan, "New compact six-band internal antenna," *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.

Hoon Park, et al. "Design of an Internal antenna with wide and multiband characteristics for a mobile handset", *IEEE Microw. & Opt. Tech. Lett.* vol. 48, No. 5, May 2006.

(56) References Cited

OTHER PUBLICATIONS

Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.
Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12. 2005.APMC 2005, Asia- Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications*, Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez- Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RF Design, "GSM/GPRS Quad Band Power Amp Includes Antenna Switch," 1 page, reprinted 11/04 issue of RF Design (www.rfdesign.com), Copyright 2004, Freescale Semiconductor, RFD-24-EK.
S. Tarvas, et al. "An internal dual-band mobile phone antenna," in *2000 IEEE Antennas Propagat. Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIllth General Assembly of International Union of Radio Science (URSI). (Oct. 23-29, 2005), 4 Pgs.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*,"Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. Of Electrical Engineering, National Sun Yat-Sen University, Sep. 2002 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30. 2013, issued by the EPO for EP Patent Application No. 12177740.3.

* cited by examiner

FIG. 1A
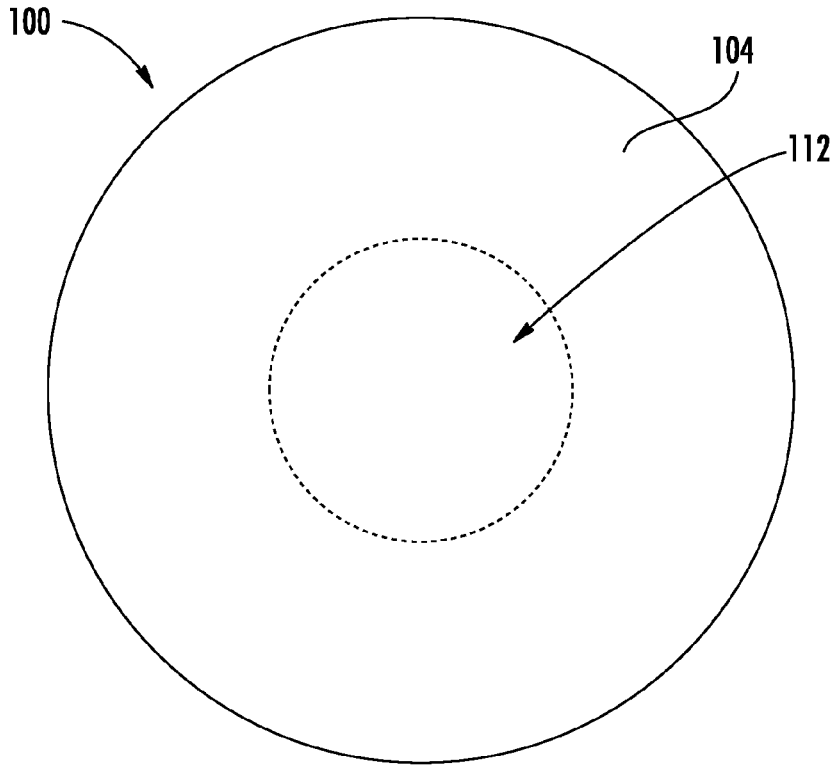
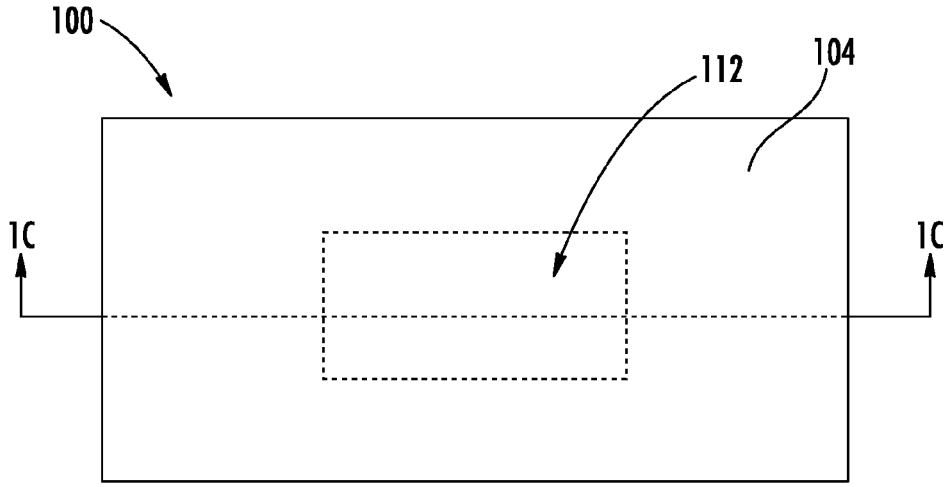
FIG. 1B

DUAL POLAR. (SLANT ± 45°)

SINGLE POLAR. (VERT.)

SINGLE POLAR. (HORIZ.)

DUAL POLAR. (90°)

MODULAR CELL ANTENNA APPARATUS AND METHODS

PRIORITY

This application claims priority to co-owned U.S. Provisional Patent Application Ser. No. 61/718,637 filed Oct. 25, 2012 of the same title, which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

Technology Field

The present disclosure relates generally to antenna apparatus for use in electronic devices such as wireless radio devices, and more particularly in one exemplary aspect to a spatially compact antenna apparatus useful on e.g., a base station or access point, and methods of manufacturing and utilizing the same.

Description of Related Technology

Radio frequency antennas are now pervasive in modern electronics, due to the widespread adoption of wireless interfaces for communication. Typical wireless applications often include some form of base station or access point, which is in data communication with a broader network, as well as one or more client or mobile devices. Alternatively, a one-way architecture may be employed (such as in the case of a GPS or GLONASS receiver receiving signals from one or more satellites).

Depending on the host device form factor (e.g., base station, mobile user device, etc.) and performance requirements, various physical configurations of antennas are utilized. Such configurations employ mechanical components to, inter alia, support the antenna radiating element(s) and related electrical/electronic components, provide environmental protection, etc. In prior art solutions, such mechanical components are typically customized for each specific antenna configuration. This approach is not optimal, in that a custom design and manufacturing cycle is typically required for each different configuration. This results in comparatively high tooling costs, and longer design cycles; the possibility of reuse of the components on any other design project/configuration is minimal as well.

Moreover, the logistics of supporting such customized configurations is not optimized. For example, different part numbers, storage/inventory, assembly lines/manufacturing equipment, materials, specifications and drawings, etc. are necessitated to support such a wide array of sui generis designs, thereby increasing labor and other costs, and ultimately the cost of the product to the host device manufacturer.

Accordingly, there is a salient need for an improved antenna solution that can provide the required electrical and other performance attributes, along with a higher degree of commonality and "reuse" opportunity, at a lower cost and complexity.

SUMMARY

The present invention satisfies the foregoing needs by providing, inter alia, improved apparatus and methods for modular and low-cost antenna design, construction and implementation, and methods associated therewith.

In a first aspect of the invention, an antenna element is disclosed. In one embodiment, the element includes: a cover element having a cavity formed therein; a main radiating element disposed substantially within the cavity; and a coupling element configured to at least electrically couple the antenna element to a host radio frequency device.

In one variant, a parasitic radiating element is formed substantially on or within the cover element; the parasitic radiating element comprises e.g., a laser direct structured (LDS) element formed on an exterior surface of the cover element.

In another variant, the element further includes an out layer disposed over the exterior surface and at least a portion of the parasitic radiating element, the outer layer selected so as to not substantially degrade the electrical performance of at least the parasitic element.

In a further variant, the antenna element further includes a back housing element configured to cooperate with the cover element so as to substantially enclose the cavity, and a ground plane disposed on the back housing.

In another variant, the antenna element comprises a substantially modular construction that is configured to enable the antenna element to be mated with at least one other similar or identical antenna element so as to form an array.

In a second aspect, an antenna array is disclosed. In one embodiment, the array includes: a plurality of substantially identical antenna elements each having: a cover element having a cavity formed therein; a main radiating element disposed substantially within the cavity; a parasitic radiating element formed substantially on or within the cover element; and a coupling element configured to at least electrically couple the antenna element to a host radio frequency device; and a feed structure configured to commonly feed each of the antenna elements.

In one variant, the array comprises the plurality of antenna elements arranged in a substantially planar array.

In another variant, the array comprises the plurality of antenna elements arranged in a substantially three-sector radial array.

In a further variant, the antenna array further includes a circuit board disposed proximate each of the antenna elements, the circuit board further comprising at least one radio frequency transceiver configured to provide a radio frequency signal to the feed network so as to drive each of the individual antenna elements.

In a third aspect of the invention, a method of manufacturing an antenna element is disclosed. In one embodiment, the method includes forming a parasitic radiator on at least a portion of a surface of an antenna radome, with a main radiator disposed substantially within an interior region of the radome. Laser direct structuring (LDS) is used in one variant to form the parasitic radiator (as well as a feed network on the back portion of the antenna element) so as to economize on space and simplify manufacturing.

In a fourth aspect of the invention, an LDS-based antenna element is disclosed. In one embodiment, a "two-shot"

molding process is used to form a radome and back cover element of the antenna element, each having specifically identified areas that contain LDS-suitable polymer so as to enable formation of an antenna or conductive trace thereon. The remaining portions of the radome/back cover are formed from a non-LDS enabled polymer such as ABS.

In a fifth aspect of the invention, a simplified antenna feed arrangement is disclosed. In one embodiment, the arrangement includes a conductive clip (e.g., C-shaped) such that custom or expensive connectors or cables used in prior art antenna feeds are obviated; the clip may merely be soldered to (or simply maintain frictional contact) with a trace or other component of the host device when the element is placed in its mounting disposition. In one variant, the clip is coupled to an LDS feed network on the antenna element, which further simplifies the feed structure.

In a sixth aspect of the invention, a method of reconfiguring an antenna array is disclosed. In one embodiment, the method includes selectively removing one or more modular antenna elements from an existing array, and placing the removed elements in a second, different configuration so as to provide different electrical and/or antenna physical (e.g., azimuthal coverage) properties.

In a seventh aspect of the invention, a method of manufacturing a low-cost, simplified antenna element is disclosed. In one embodiment, the method includes: forming a front cover element and a rear cover element, at least one of the front and rear cover elements formed using first and second types of material; activating relevant portions of at least one of the front and rear covers containing the first type of material; utilizing an electroless process so as to accrete a plurality of conductive elements on the activated portions; disposing a ground plane onto the back cover element; disposing a main radiator element on the back cover element; affixing a feed conductor to at least one of the accreted conductive elements; and joining the front and rear cover elements.

Further features of the present invention, its nature and various advantages will be more apparent from the accompanying drawings and the following detailed description.

BRIEF DESCRIPTION OF THE DRAWINGS

The features, objectives, and advantages of the disclosure will become more apparent from the detailed description set forth below when taken in conjunction with the drawings, wherein:

FIGS. 1A and 1B are front elevation views of first and second embodiments of a low-cost modular antenna element configured according to the disclosure, respectively.

Figure 1C:
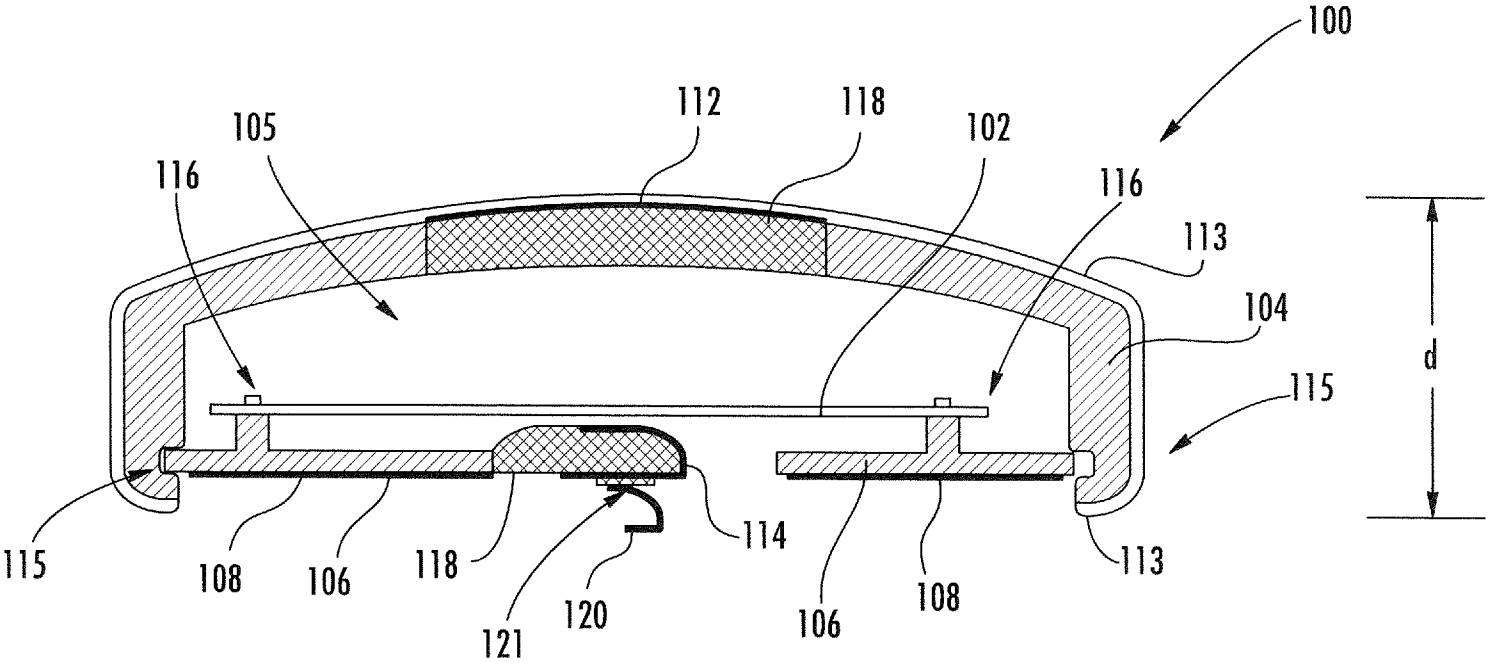
FIG. 1C is a cross-sectional view of the antenna element of FIG. 1B taken along line 1C-1C, showing the interior components and construction thereof.

All Figures disclosed herein are ©Copyright 2012-2013 Pulse Finland Oy. All rights reserved.

DETAILED DESCRIPTION OF THE PREFERRED EMBODIMENT

Reference is now made to the drawings wherein like numerals refer to like parts throughout.

As used herein, the terms "antenna," and "antenna system," refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

As used herein, the terms "portable device", "mobile device", "client device", "portable wireless device", and "host device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

Furthermore, as used herein, the terms "radiator," and "radiating element" refer without limitation to an element that can function as part of a system that receives and/or transmits radio-frequency electromagnetic radiation; e.g., an antenna.

The terms "RF feed," "feed" and "feed conductor" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", "back", "front", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, NFC/RFID, CDPD, satellite systems such as GPS, millimeter wave or microwave systems, optical, acoustic, and infrared (i.e., IrDA).

Overview

The present disclosure provides, in one salient aspect, a spatially compact and modular antenna element that can be used either alone or as a basic "building block" for larger arrays and sectorial antennas (i.e., by joining needed number of elements together). Thus, the same parts can be reused for various complete product designs, thereby advantageously reducing the need for customized parts (and the attendant disabilities associated therewith, as discussed supra). Moreover, multiple antenna elements can be readily joined together via a common feed network (in one implementation, via the back portion of each element). The antenna gain and beam width are also adjustable through configuration of the array (and the construction of the antenna elements themselves).

In one exemplary application, a base station (e.g., a Small Cell Base Station (SCBS)) unit can be configured (and rapidly reconfigured) with the antenna elements disclosed herein based on individual cell site needs. For instance, the modular antenna elements disclosed herein can be used to configure a 6-sector 360-degree coverage array, or a 3-sector 180-degree coverage array. Likewise, planar or even hybrid (e.g., angular/planar) arrays can readily be formed.

In another aspect, a simplified RF contact configuration is presented to connect the antenna element feed point(s) to the host radio device without need of specific connectors or cables, thereby advantageously further simplifying the use of the element(s) in various applications.

DETAILED DESCRIPTION OF EXEMPLARY EMBODIMENTS

Detailed descriptions of the various embodiments and variants of the apparatus and methods of the disclosure are now provided. While primarily discussed in the context of base stations or access points, the various apparatus and methodologies discussed herein are not so limited. In fact, the apparatus and methodologies of the disclosure may be useful in any number of antennas, whether associated with mobile or fixed devices.

Exemplary Antenna Element Apparatus and Methods

Referring now to FIGS. 1A-1C, an exemplary embodiment of the antenna element 100 configured in accordance with the disclosure is shown and described. FIG. 1A illustrates a generally round (circular) embodiment of the antenna element 100, while FIG. 1B illustrates a rectangular embodiment of the element (which may be readily fashioned as a square shape as well). While the electrical performance of both form factors is similar, certain advantages are associated with the rectangular/square shape in certain applications, including the elimination of gaps left between the elements when assembled in an array (as discussed below). Thus, a substantially "sealed" surface can be formed, which has environmental as well as aesthetic benefits. With the circular elements of FIG. 1A, extra parts/material is needed between elements to fill the gaps and enable joining the elements together.

The illustrated antenna elements 100 of FIGS. 1A-1C each comprise a main radiator element 102, a front cover element (aka radome) 104 with cavity 105 formed therein, a rear cover element 106 with ground plane 108, and a contact element 121. The radome 104 may also include (i) a parasitic radiator element 112 and/or (ii) a covering 113 (e.g., layer of material such paint, laquer, rubber, another layer of plastic, etc.) deposited over at least a portion of the radome 104 for aesthetic reasons as well as environmental robustness (e.g., to inhibit UV damage to the radome 104 or other components due to extended exposure to the sun, moisture, abrasive agents, etc.).

It is noted, however, that even if the mechanical shape of the element cover 104 is square or rectangular as in FIG. 1B, the actual antenna radiator element 102 can be circular, or vice versa.

In one variant, the radome 104 is snap-fit 115 to the rear cover element 106 so as to provide mechanical stability and ease of assembly/disassembly; however, it will be appreciated that other fastening techniques may be used in place of or in conjunction with the foregoing, including e.g. use of adhesives, fasteners, heat staking of one component to the other, press-fit or other frictional technologies, and so forth, as will be recognized by those of ordinary skill given the present disclosure.

Moreover, it can be appreciated that the radome may take on any number of different shapes, the illustrated outwardly (convex) shapes of FIGS. 1A-1C being merely exemplary. For instance, the radome may have a flat (planar shape), or even outwardly concave shape if desired. Similarly, the main radiator 102 may assume different shapes, and/or numbers of constituent elements (e.g., may be angled, bent or curved, comprised of two or more constituent radiator elements, etc.). It is also possible to leave the main radiator 102 out of the element 100 in some cases. The parasitic radiator 112 is such cases functions as the main radiator. As another possibility, metal plating may be applied on both sides of the radome 104. In this fashion, a stacked "patch" (main radiator and parasitic element) can be formed without additional parts.

The antenna element 100 of FIGS. 1A-1C further includes a feed network (with feed point and electromagnetic coupling element) 114 that is, in the illustrated embodiment, applied to the back cover element 106 via an LDS process (described in greater detail below). The back cover element 106 further includes posts 116 to support and retain the main radiator 102, (e.g., by heat staking or other suitable method).

By altering the back cover shape, the antenna elements 100 can advantageously be joined together using a common feed network, which further simplifies the resulting array apparatus.

Figure 1D:
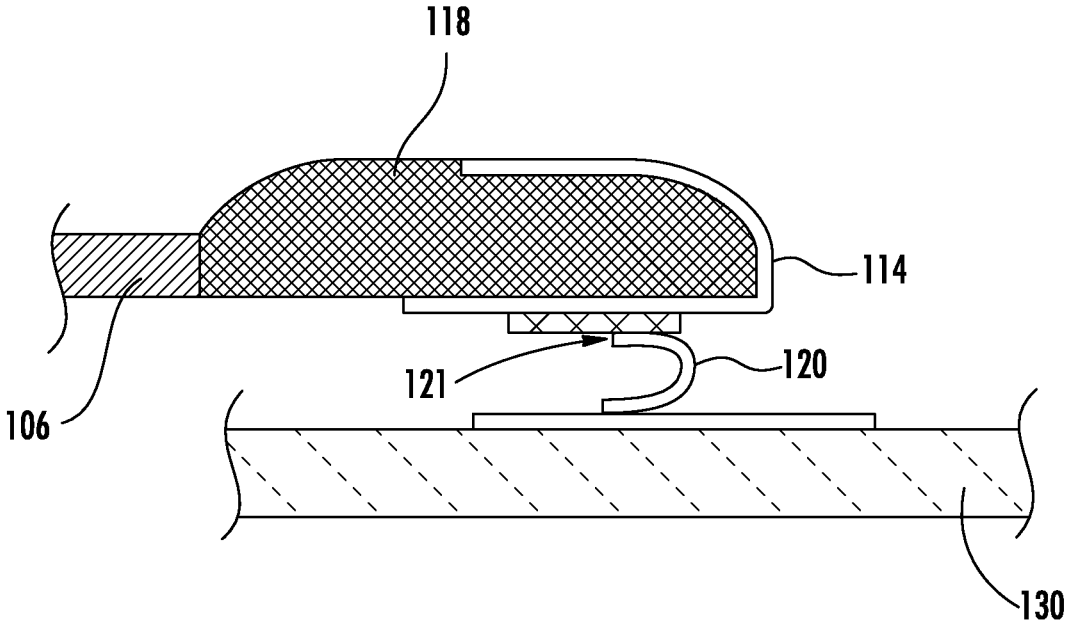
FIG. 1D is a detail of the feed network region of the antenna element shown in FIG. 1C.
Figure 2A:
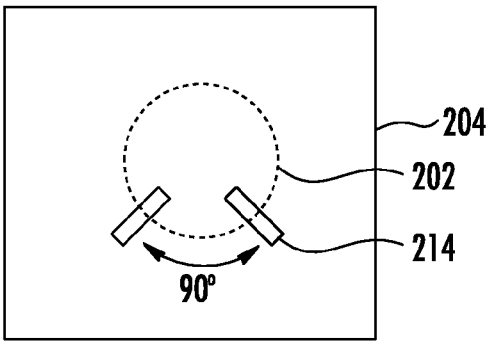
FIGS. 2A-2D illustrate various possible polarizations imparted by the antenna element of FIGS. 1A-1B, including dual polarization (+/−45 degrees and 90 degrees), and single polarization (vertical, horizontal).
Figure 2B:
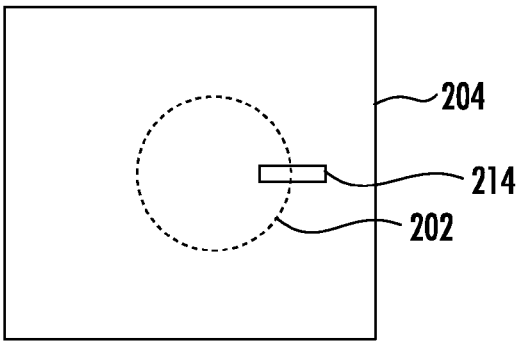
Figure 2C:
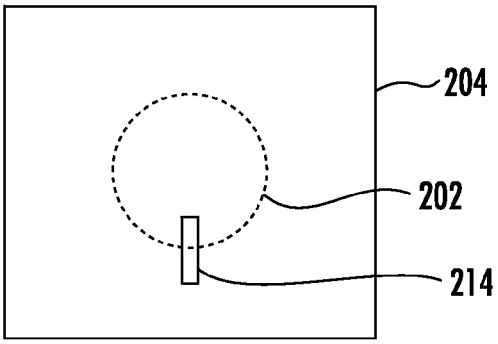
Figure 2D:
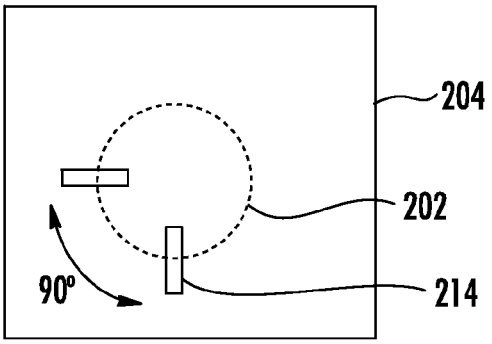

A conductor (in this embodiment, a "C" shaped clip with some resiliency) 120 is also provided to facilitate electrical connection to a host device (e.g., substrate with radio transceiver circuits 130; shown in FIG. 1D). The clip 120 is soldered 121 or otherwise bonded to the feed network 114 so as to form electrical contact therewith. The placement and shape of the clip 120 facilitates ready connection (e.g., frictional contact by virtue of the spring force of the clip, and soldering if desired) to the host device (e.g., a copper layer disposed on a host radio PCB or the like, which is disposed proximate to the rear cover element 106 of the antenna element(s) 106). The C-shaped clip 120 may also be configured to enable mechanical connection to the host device; e.g., by receipt of a portion of the host device structure (e.g., PCB) into the interior region of the clip 120 such that it is frictionally retained therein, such as in the case of a board edge connection.

Use of the foregoing C-clip arrangement advantageously (i) allows for positive mechanical (and hence electrical) frictional contact with a host device without necessitating soldering or other bonding, and (ii) obviates the use of specialize connectors or cables (e.g., coaxial or otherwise), thereby reducing cost and increasing simplicity of design and manufacturing. It will be appreciated, however, that other shapes and/or orientations of conductor may be used with equal success, depending on the particular application. For instance, the C-clip may be oriented at 90 degrees to that illustrated (i.e., rotated out of the plane of the antenna element) and elongated as needed so as to facilitate "side" mounting.

It is further appreciated that while the exemplary embodiment only illustrates the use of one RF feed point, and one main radiator element, the present disclosure is not so limited, and may be implemented with any number of RF feed points (e.g. two-feed, three-feed), as well as any number of antenna elements and/or switching elements as may be required by the particular application.

Moreover, while the parasitic element 112 is shown disposed (e.g., printed) on the outer or convex surface of the cover element (radome) 104, the parasitic element may be formed on the interior (concave) surface, or two or more elements formed on both surfaces if desired. In that no electrical connections are required to the parasitic element(s) 112, their number and location may be varied as required by the application and is facilitated through the use of the multi-dimensional LDS process.

In the exemplary embodiment of FIG. 1C, the main radiator 102 is formed from sheet metal (e.g., an alloy of CuSn, stainless steel, etc.), while the parasitic radiator 112 is formed into the three-dimensional radome outer (and/or inner) surface with a laser direct structuring (LDS) or pad printing process. Specifically, recent advances in antenna manufacturing processes have enabled the construction of antennas directly onto the surface of a specialized material (e.g., thermoplastic material that is doped with a metal additive). The doped metal additive is activated by means of a laser, which enables the construction of antennas onto more complex 3-dimensional geometries. For instance, in a typical smartphone application, the underlying smartphone housing, and/or other components which the antenna may be disposed on or inside the device (in the present element 100, the radome 104), may be manufactured using this specialized material, such as for example using standard injection molding processes. A laser is then used to activate areas of the (thermoplastic) material that are to be subsequently plated. An electrolytic copper bath followed by successive additive layers such as nickel or gold may then be added if needed to complete the construction of the antenna.

In the illustrated element 100 of FIG. 1C, a "two-shot" molding process is utilized for formation of the radome 104, and the back cover element 106. Two-shot molding is an injection molding process using two different resins e.g., an ABS and an LDS plastic 118; however, only one of the two resins is plate-able.

In the exemplary embodiment where LDS is used, 2-shot molding can advantageously be used to limit usage of LDS plastic 118 to only within the (parasitic) radiator area of the radome 104, and the feed network area 114 of the back cover element 106.

In an alternative embodiment, the aforementioned "2-shot" molding process is obviated through use of a pad printing technique (or other non-LDS printing technique) to form the parasitic radiator 112 on the radome.

In one variant, the LDS parasitic radiator 112 as described above is generally retained; however, manufacturing time can advantageously be reduced by using a meshed or "raster" surface (instead of consistent metallization as in the prior embodiment). Specifically, instead of fully metallized surface, a fine "mesh" is formed. Pitch size of the mesh in the exemplary embodiment is small enough so that from an electromagnetic point of view, the surface appears consistent. When the entire surface does not require the lasering process, a proportional saving in laser treatment time is achieved. Moreover, the amount of metal used is also advantageously reduced. Such rastering (and/or cross-hatching) can be used also in the pad printing process; in that case, the cost saving stems mainly from the reduced amount of metal required.

In the exemplary embodiment, polarization of the antenna element 100 can be selected by altering the feed coupling element configuration, single port, dual port, vertical, horizontal, slant+/−45-deg. polarizations are possible; see the exemplary configurations of FIGS. 2A-2D. In these figures, the square shapes 204 comprise an outer perimeter of an exemplary (square) radome, shown from a perspective of the front face thereof. The circular shape is the main radiator 202. The tabs 214 comprise radiator feed points.

The ground plane 108 of the exemplary element 100 comprises a metallic (e.g., copper alloy) layer that in the present embodiment is screen-printed onto the exposed portion of the back cover element 106. As is known, screen printing is a printing technique that uses a woven mesh to support an blocking stencil. The attached stencil forms open areas of mesh that transfer printable material which can be pressed through the mesh as a sharp-edged image onto an underlying substrate. Through placement of the ground plane on the back cover element of the antenna element 100, additional ground (GND) clips can be readily added between ground plane and radio board as needed. The ground plane can be alternatively formed using sheet metal, FPC or other metallization technique (rather than screen printing).

Advantages of the exemplary embodiment of the antenna element 100 include: (i) reduced number of physical parts as compared to prior art solutions; (ii) reduced overall thickness (d) of the element 100 as shown in FIG. 1C, thereby allowing for more spatially compact and less aesthetically "intrusive" designs; (iii) industrial "design freedom" resulting from use of 3D-friendly manufacturing technologies such as LDS; (iv) reusable/reconfigurable antenna elements useful in various base station or other array configurations;

(v) low tooling cost due to, inter alia, smaller size thereby requiring less material; (vi) shorter manufacturing lead times/time to market due to obviation of custom designs; (vii) scalability for various frequency bands; and (viii) simple RF contact (e.g., C-clip 120) method from antenna to radio board, thereby obviating custom/expensive RF connectors or cables.

Moreover, the antenna elements disclosed herein have improved RF properties (resulting from, inter alia, the main radiator 102 being disposed in close proximity to the radome). In such a configuration, electrical performance is improved, since the parasitic radiator (or main radiator in the alternate embodiment referenced above) can be formed on the outer surface of the radome 104. Then radome material losses accordingly have little or no effect on antenna radiating performance. Also, the distance between the reflector (ground plane 108) and main radiator 102 can be maximized for a given mechanical height, since the relevant radiator can be formed onto the outer surface of the radome. In conventional antenna technology, the radiator(s) is/are below the radome, and thus closer to the ground plane.

Antenna Array Apparatus

As indicated above, one salient advantage of the disclosure is its use of identical (or substantially identical) modular antenna elements as "building blocks" which can be joined together in variety of ways to form antenna arrays, panels, columns (cylinders) or other shapes such as polygons. Moreover, various components (e.g., end caps, rear housing element, etc.) can be accommodated into the basic antenna element 100 to form variety of sizes and shapes of antenna assembly, as described in greater detail below. The foregoing capability allows the antenna elements to be largely "commoditized" and have interchangeability, thereby simplifying manufacturing, inventory management, and assembly into antenna arrays.

Moreover, it will be appreciated that the antenna apparatus may be constructed to have at least two-dimensional non-chirality (aka "handedness"), such that its orientation is not critical to its operation. This is particularly useful in manufacturing; i.e., a human or pick-and-place machine may pick up the non-chiral antenna elements as they arrive or are positioned in a source device without having to orient them with respect to the non-chiral dimension(s) before assembly. For instance, considering the round embodiment of FIG. 1A discussed above, the parasitic radiator, main radiator, and feed coupling clip 120 can be structured to mate with the host device in any orientation (e.g., by placing the clip dead-center on the element 100), such that any angular rotation around the central axis is acceptable for purposes of electrical connection to the host, and for the beam pattern (main lobe) of the antenna during operation.

In the exemplary embodiments of the antenna array, the antenna gain and beam width are adjustable by way of the array configuration. For instance, single element 100 can achieve a gain 7 dBi, horizontal 3 dB beam width 65 deg, vertical 3 dB beam width 50 deg. A 1×2 vertical array can achieve a gain 9.5 dBi, horizontal 3 dB beam width 60 deg, vertical 3 dB beam width 30 deg.

Figure 3:
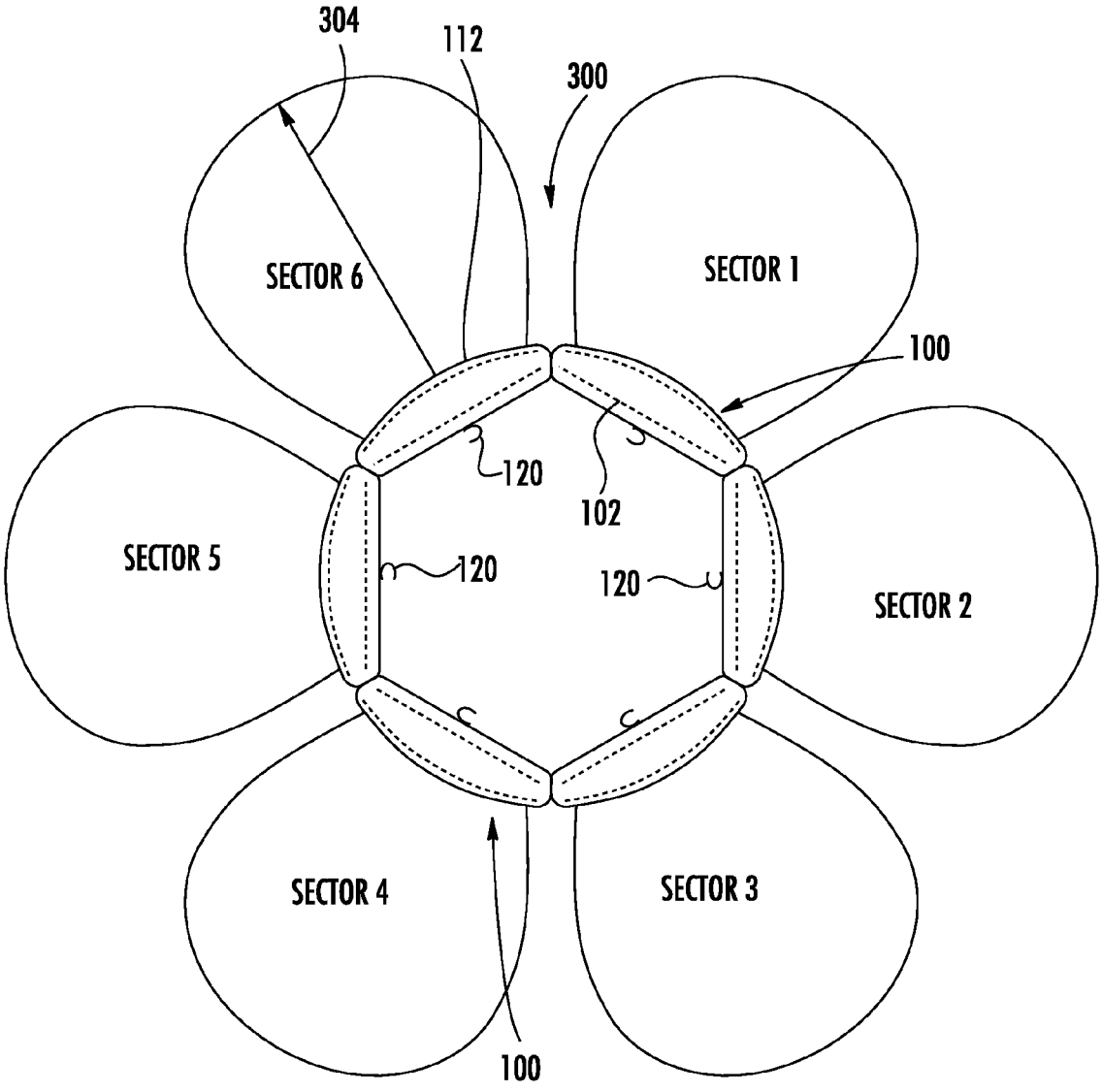
FIG. 3 is a top elevation view of one exemplary embodiment of an antenna array apparatus according to the disclosure (hexagonal; six-sector; 360-degree).

In one configuration of the apparatus, a six-sector array 300 with 360-degrees of coverage is formed using six substantially identical antenna elements 100, as shown in FIG. 3 (radio components not shown for clarity). Hence, each element 100 subtends an arc of 60-degrees, with the radiating (receiving) lobe 304 extending therefrom as shown.

Figure 4:
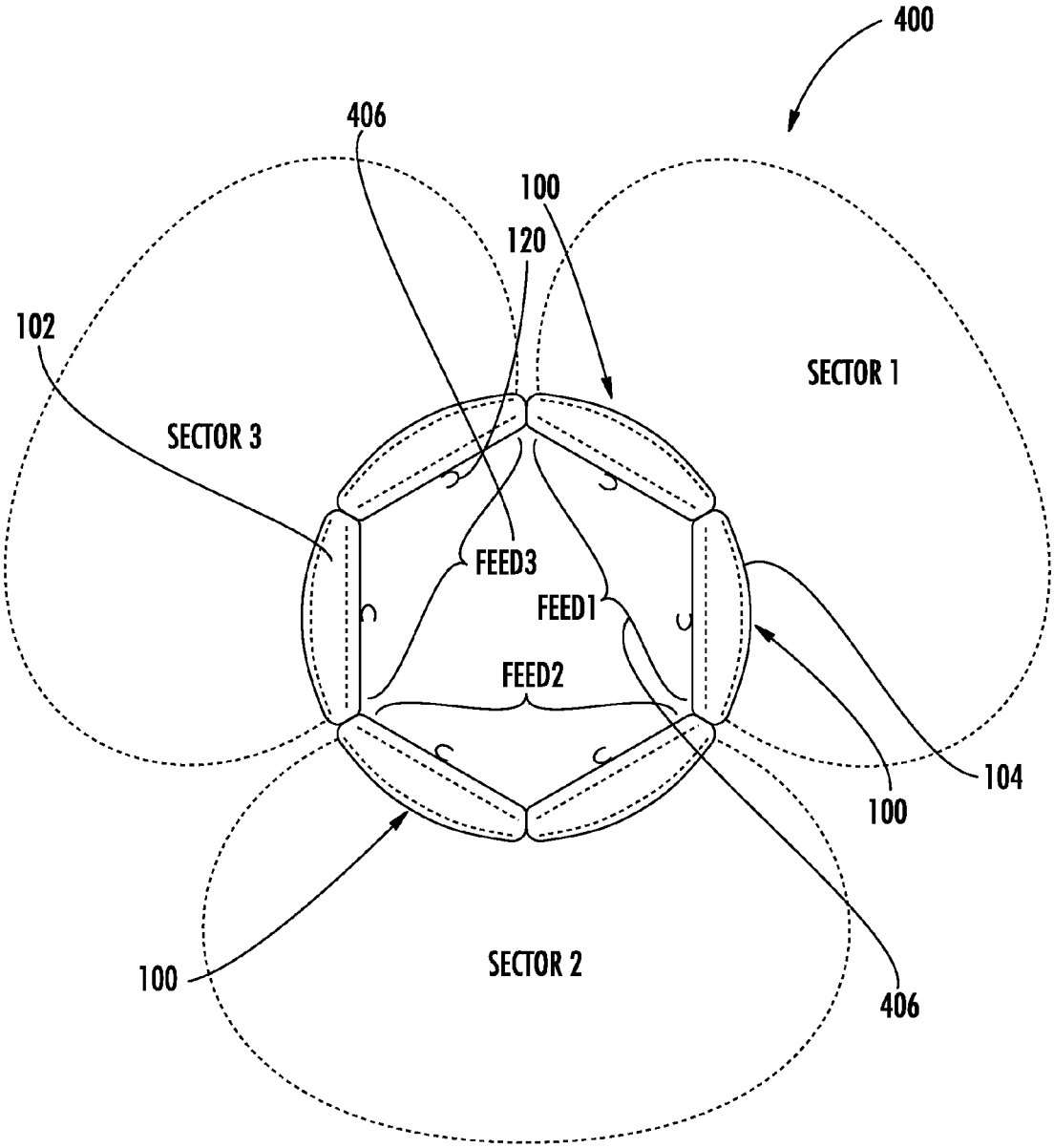
FIG. 4 is a top elevation view of another exemplary embodiment of an antenna array apparatus according to the disclosure (hexagonal; three-sector; 360-degree).

In another configuration, a six-element array 400 is formed, yet with pairs 406 of adjacent elements being coordinated such that three radiating/receiving sectors are formed to cover 360 degrees, as shown in FIG. 4.

Figure 5:
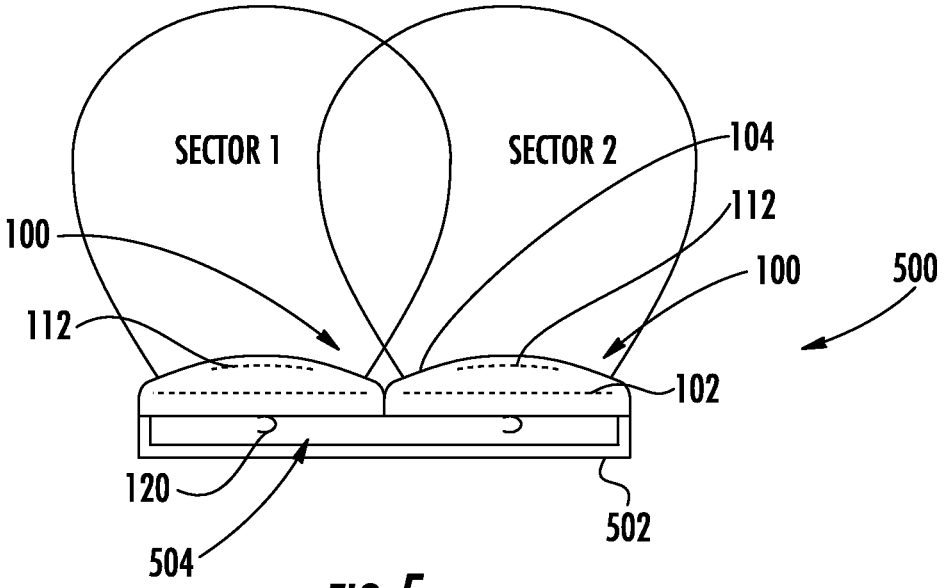
FIG. 5 is a top elevation view of another exemplary embodiment of an antenna array apparatus according to the disclosure (planar; two-sector; for e.g., wall or ceiling mounting).

In another configuration, a two-element planar array 500 is formed as shown in FIG. 5. In this embodiment, a rear support member 502 with interior cavity 504 (e.g., for radio components, not shown) is used, although this configuration is but one possible option.

Figure 6:
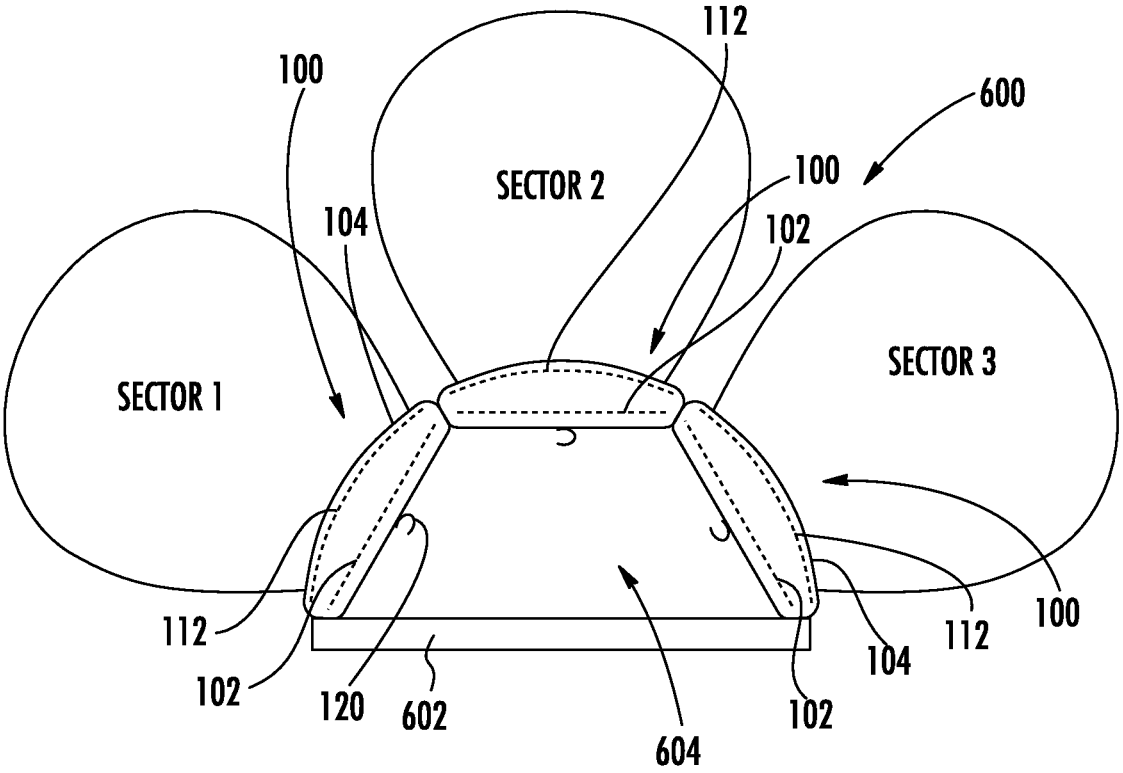
FIG. 6 is a top elevation view of yet another exemplary embodiment of an antenna array apparatus according to the disclosure (hemispherical; three-sector; 180-degree).

In yet another configuration, a 3-element hemispherical (180-degree coverage) array is formed, the array having three radiating sectors as shown in FIG. 6. A rear support member 602 with cavity 604 is also provided.

Figure 7:
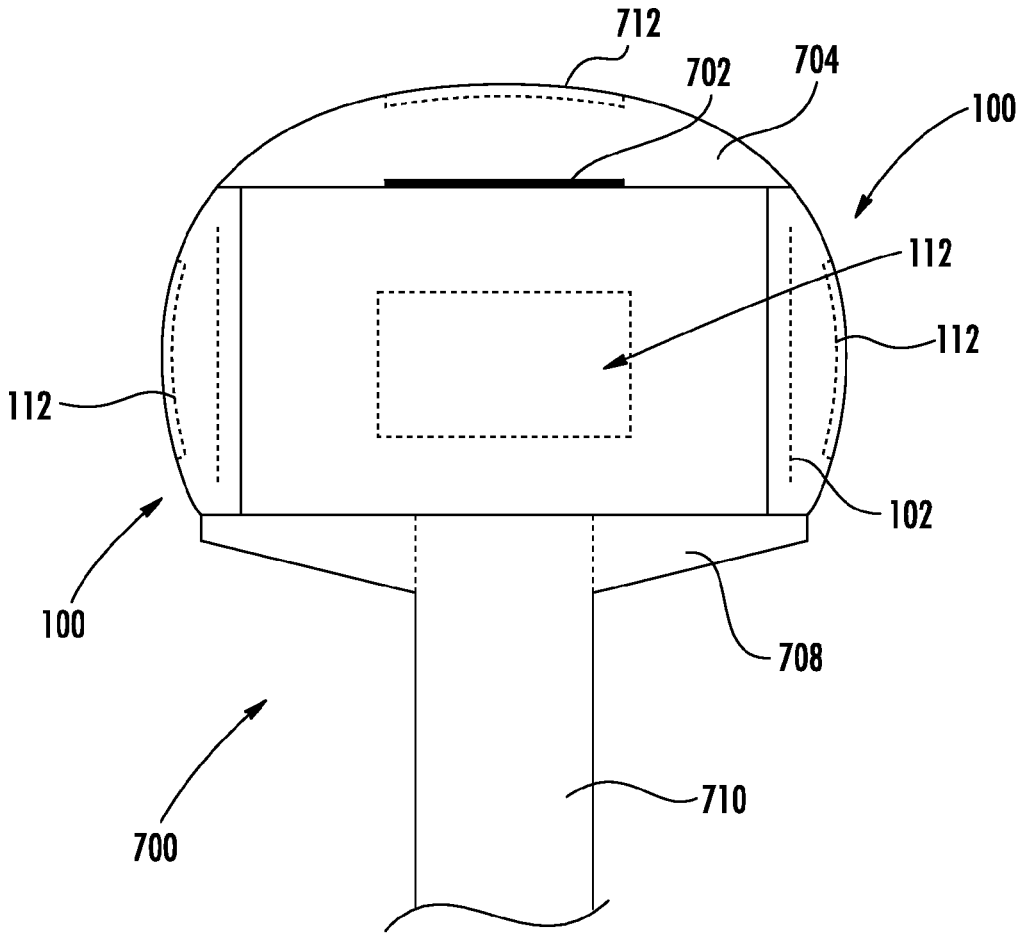
FIG. 7 is a side elevation view of one exemplary embodiment of an antenna array apparatus according to the disclosure, configured for pole mounting (rectangular four-sector array plus fifth upward sector).

FIG. 7 shows an exemplary embodiment of a pole-mounted antenna array 700 configured according to the disclosure. In this embodiment, four (4) side elements are employed (each having an antenna element 100), and oriented substantially normal to the longitudinal axis of the pole 710. It will be appreciated, however, that any number of other configurations and/or number of elements may be utilized; e.g., six elements in a hexagonal pattern, three elements in a triangular pattern, and so forth. The exemplary configuration of FIG. 7 also includes an optional top-side antenna element 704, which can be used for either heterogeneous or homogeneous RF signals. For example, in one such heterogeneous embodiment, the tope-side element 704 (with embedded main and parasitic elements 702, 712) is configured as a GPS timing or GLONASS antenna, while the four (or other number) of side elements are cellular (e.g., LTE or GSM or CDMA), WMAN (e.g., WiMAX), or the like.

Figure 8:
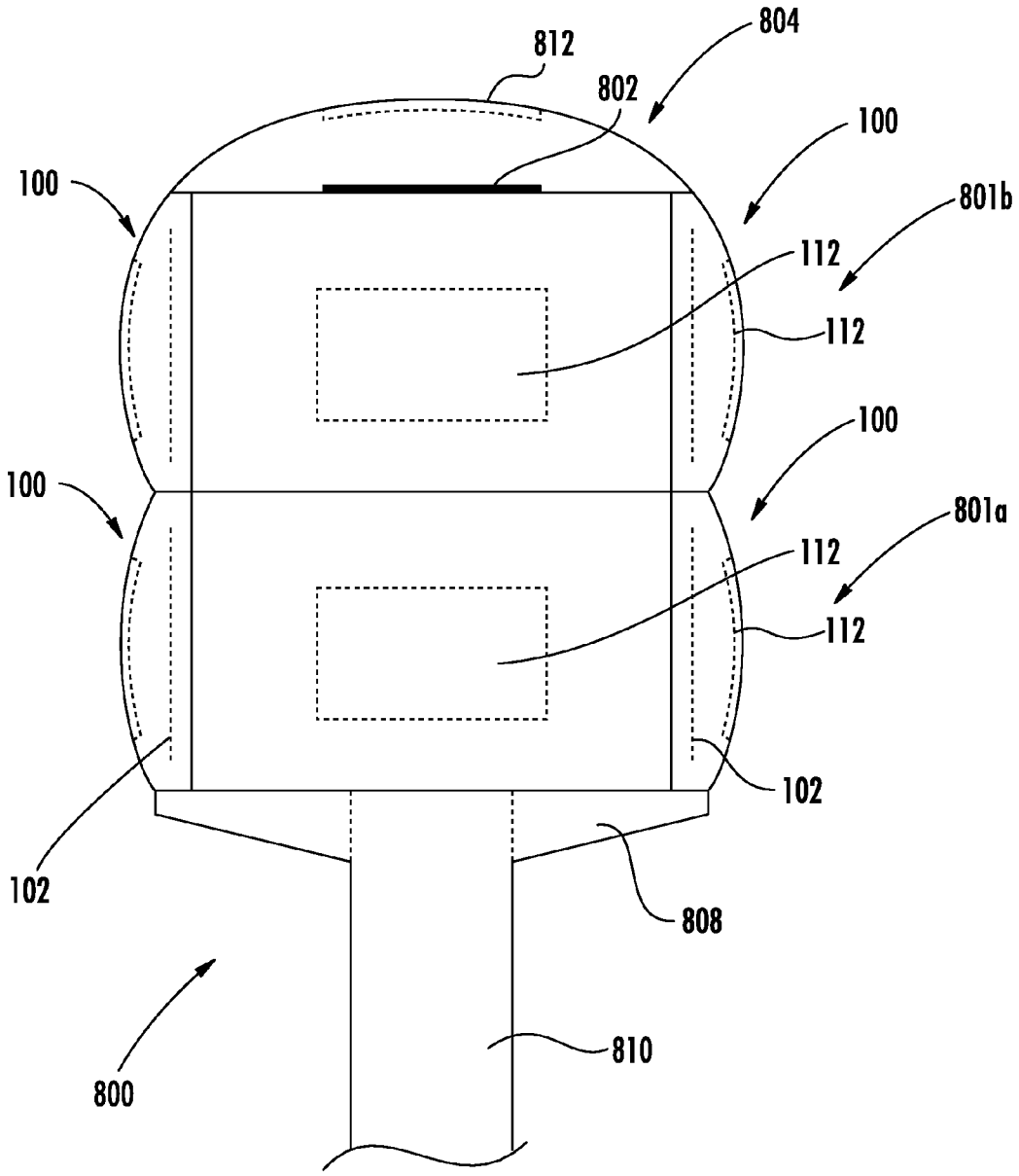
FIG. 8 is a side elevation view of another exemplary embodiment of an antenna array apparatus according to the disclosure, configured for pole mounting (two stacked rectangular four-sector arrays plus ninth upward sector).

FIG. 8 shows another variant of the pole-mounted configuration, wherein a stacked or layered approach is utilized. In this embodiment, two rows 801*a*, 801*b* of antenna elements are stacked vertically (one atop the other), and oriented consistent with each other (i.e., so that the elements of the top row 801*b* sit directly atop and aligned with those of the lower row 801*a* when viewed from above. It will be appreciated however that the two (or more) rows may be (i) offset and/or rotated with respect to one another in azimuth; e.g., by 90 degrees; (ii) comprise different numbers of antenna elements (e.g., four on the bottom row, and six on the top row), (iii) may be mounted or constructed such that the main lobe axes are not parallel (e.g., the top row lobe axes canted upward by say 20 degrees from horizontal, while the lower row axes are canted upward at e.g., 10 degrees, or downward at 20 degrees), and/or (iv) comprised of different types of elements (e.g., a first frequency band for the top row, and a second different or partly overlapping frequency band for the bottom row). Hence, myriad different permutations and combinations of the number of elements, number of rows, heterogeneity or homogeneity of the elements, their spatial placement, orientation, and/or disposition, will be recognized by those of ordinary skill given the present disclosure. An optional top element 804 may be used (e.g., for GPS timing or other), with main and parasitic radiator elements 802, 812, if desired.

Figure 9:
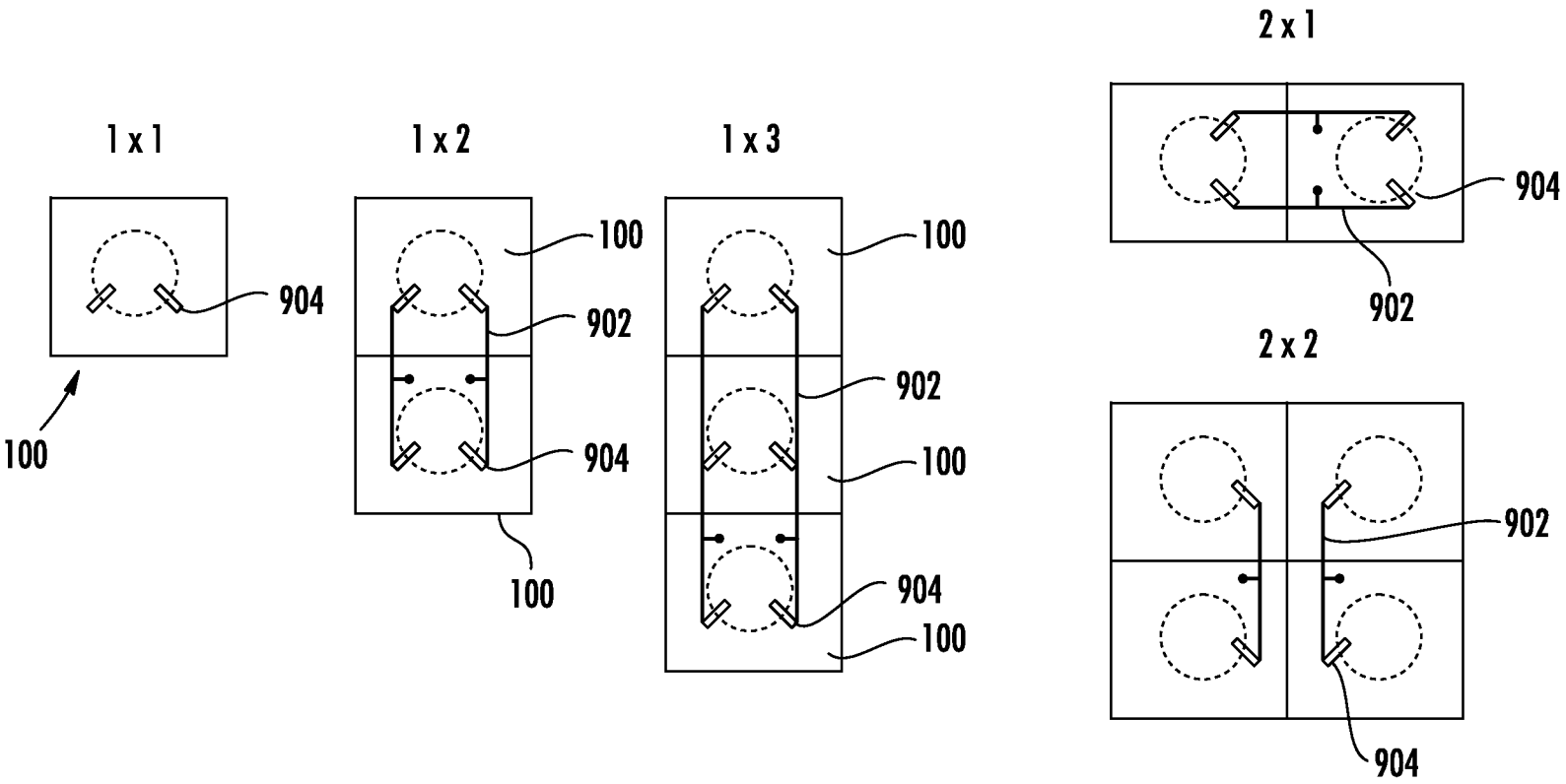
FIG. 9 is a schematic diagram illustrating various feed connection topologies for different antenna element array configurations.

FIG. 9 is a schematic diagram illustrating various feed connection topologies for different antenna element array configurations (i.e., 1×1, 1×2, 1×3, 2×1, and 2×2). In FIG. 9, the lines 902 show the feed network configured to combine individual radiating elements 100 together to form an antenna array. The black dots 904 (2 in each configuration) are the feed points of the array. It is noted that the 1×2 and 2×1 variants are electrically identical, but rotated 90 degrees; the horizontal and vertical beam width of the array radiation pattern of the exemplary embodiment are also reversed when the element is rotated. Hence, in the illustrated configurations, the 1×2 array gives a wide horizontal beam and narrow vertical beam, while the 2×1 beam horizontal and vertical widths are the opposite.

Figure 10:
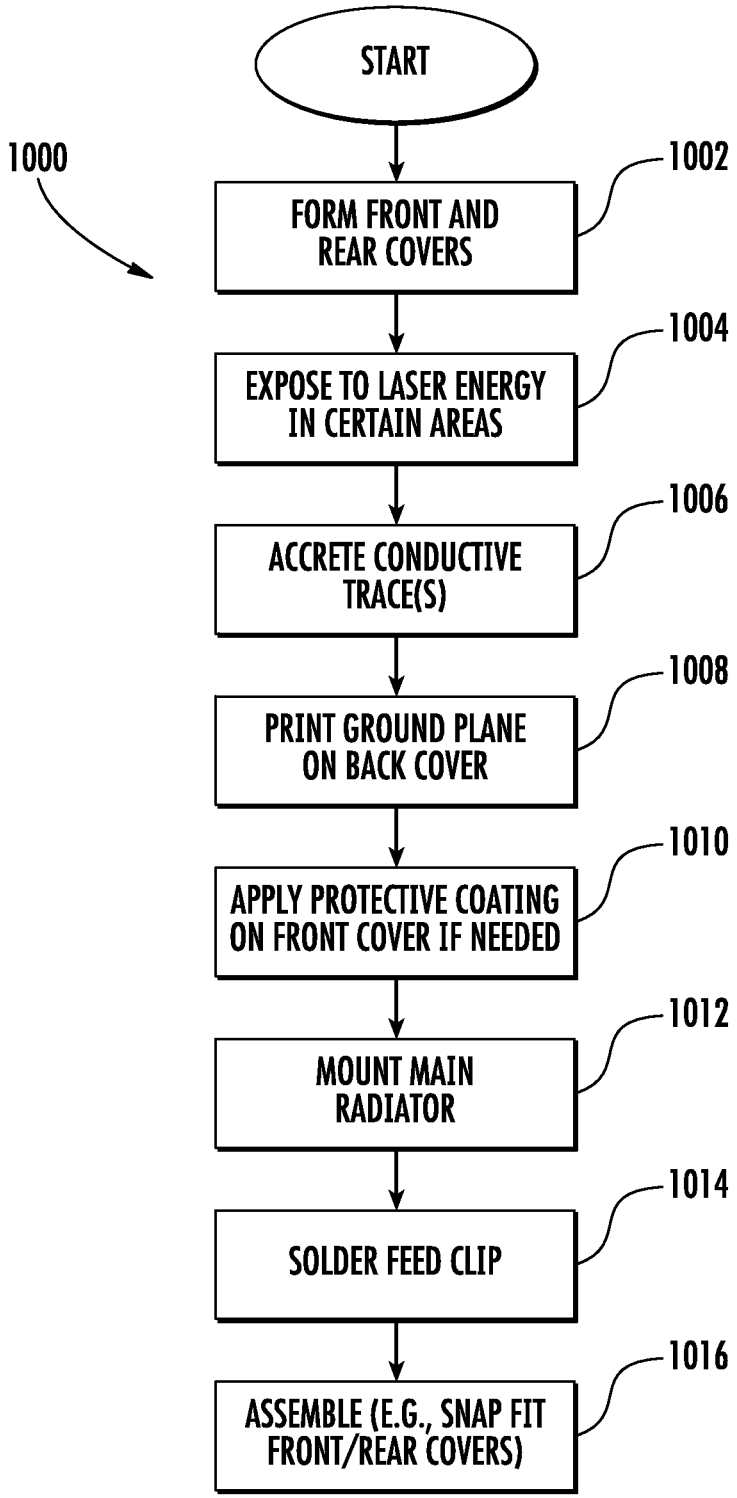
FIG. 10 is a logical flow diagram illustrating one generalized method of manufacturing the antenna element of FIGS. 1A-1D.

FIG. 10 is a logical flow diagram illustrating one generalized method of manufacturing the antenna element of FIGS. 1A-1D. In this method 1000, the first step is to form the cover element 104 and the rear cover element 106, such as via the aforementioned exemplary "two-shot" injection molding process (step 1002).

Next, relevant portions of the front and rear covers (i.e., those with LDS plastic) are ablated using a laser according to the prescribed LDS process, so as to activate the dopant material contained therein (step 1004).

Per step 1006, the components 104, 106 are then placed in an electroless process so as to build up the desired conductive traces (e.g., parasitic radiator 112, feed network 114, etc.) on the ablated LDS portions.

After completion of step 1006, the ground plane is screen printed onto the relevant portions of the back cover element 106 per step 1008. Any protective coating 113 desired on the front cover 104 may also now be applied per step 1010.

At step 1012, the main radiator element 102 is heat-staked to the rear cover element at the supports 116 (FIG. 1C), and the C-clip soldered to the feed network trace 114 per step 1014. The front cover element 104 is then snapped onto the rear cover assembly at step 1016, and the assembly process is complete.

It will be appreciated that the modular antenna elements disclosed herein (e.g., those of FIGS. 1A and/or 1B, or yet other shapes) may be arranged in a wide variety of shapes and configurations, including for example a dodecahedron, spherical truncated icosahedrons (aka soccer ball), etc. The foregoing shapes and array configurations are accordingly merely illustrative.

It will be recognized that while certain aspects of the disclosure are described in terms of a specific sequence of steps of a method, these descriptions are only illustrative of the broader methods, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure and claims provided herein.

While the above detailed description has shown, described, and pointed out novel features as applied to various embodiments, it will be understood that various omissions, substitutions, and changes in the form and details of the device or process illustrated may be made by those skilled in the art. The foregoing description is of the best mode presently contemplated. This description is in no way meant to be limiting, but rather should be taken as illustrative of the general principles of the disclosure.

What is claimed is:

1. An antenna element, comprising:

a cover element having a cavity formed therein;

a main radiating element disposed substantially within the cavity;

a coupling element configured to at least electrically couple the antenna element to a host radio frequency device; and a parasitic radiating element formed substantially on or within the cover element;

wherein at least a portion of the cover element is disposed between the main radiating element and the parasitic radiating element; and wherein the antenna element further comprises a substantially modular construction that is configured to enable the antenna element to mate with at least one other similar or identical antenna element so as to form an array, the at least one other similar or identical antenna element comprising:

another cover element having another cavity formed thereon;

another main radiating element disposed substantially within the other cavity;

another coupling element configured to at least electrically couple the at least one other similar or identical antenna element to the host radio frequency device; and another parasitic radiating element formed substantially on or within the other cover element;

wherein at least a portion of the other cover element is disposed between the other main radiating element and the other parasitic radiating element.

2. The antenna element of claim 1, wherein the parasitic radiating element comprises a laser direct structured (LDS) element formed on an exterior surface of the cover element.

3. The antenna element of claim 2, further comprising an outer layer disposed over the exterior surface of the cover element and at least a portion of the parasitic radiating element, the outer layer selected so as to not substantially degrade an electrical performance of at least the parasitic radiating element.

4. The antenna element of claim 1, further comprising:

a back housing element configured to cooperate with the cover element so as to substantially enclose the cavity; and a ground plane disposed on the back housing element.

5. The antenna element of claim 1, wherein the coupling element is further configured to enable a mechanical coupling of the antenna element to a substrate of the host radio frequency device.

6. An antenna array, comprising:

a plurality of modular antenna elements each comprising:

a distinct cover element having a cavity formed therein;

a distinct main radiating element disposed substantially within the cavity; and a coupling element configured to at least electrically couple the antenna element to a host radio frequency device; and a feed structure configured to commonly feed each of the plurality of modular antenna elements;

wherein the plurality of modular antenna elements are each configured to be joined to one another in one of a plurality of differing configurations.

7. The antenna array of claim 6, wherein the antenna array comprises the plurality of modular antenna elements arranged in a substantially planar array.

8. The antenna array of claim 6, wherein the antenna array comprises the plurality of modular antenna elements arranged in a substantially three-sector radial array.

9. The antenna array of claim 6, further comprising a circuit board disposed proximate each of the plurality of modular antenna elements, the circuit board comprising at least one radio frequency transceiver configured to provide a radio frequency signal to the feed structure so as to drive each of the individual antenna elements.

10. The antenna array of claim 6, wherein at least one of the plurality of modular antenna elements further comprises a parasitic radiating element formed substantially on or within the cover element.

11. The antenna array of claim 10, wherein at least one of the plurality of modular antenna elements further comprises an outer layer disposed over an exterior surface of the cover element and at least a portion of the parasitic radiating element, the outer layer selected so as to not substantially degrade an electrical performance of at least the parasitic radiating element.

12. The antenna array of claim 11, wherein at least one of the plurality of modular antenna elements further comprises:

a back housing element configured to cooperate with the cover element so as to substantially enclose the cavity; and a ground plane disposed on the back housing element.

13. The antenna array of claim 11, wherein at least one of the plurality of modular antenna elements comprises a first conductive region that has been deposited on the at least one antenna element by a laser-direct structuring (LDS) process, and a second conductive region that has been deposited using a printing process.

14. An antenna element, comprising:

a cover element having a cavity formed therein;

a back housing element configured to cooperate with the cover element so as to substantially enclose the cavity;

a main radiating element disposed substantially within the cavity;

a coupling element configured to at least electrically couple the antenna element to a host radio frequency device;

a laser direct structured (LDS) parasitic radiating element formed on an exterior surface of the cover element; and a ground plane disposed on the back housing element;

wherein the coupling element is further configured to enable a mechanical coupling of the antenna element to a substrate of the host radio frequency device; and wherein the antenna element comprises a substantially modular construction that is configured to enable the antenna element to be mated with at least one other similar or identical antenna element comprised of another cover element that is distinct from the cover element of the antenna element so as to form an array.

15. The antenna element of claim 14, wherein the coupling element is further configured to be altered to polarize the antenna element.

* * * * *